US005477656A

United States Patent [19]

Loewenthal

[11] Patent Number: 5,477,656

[45] Date of Patent: Dec. 26, 1995

[54] APPARATUS FOR MAKING GROUPS OF INTERCONNECTED BAG PACKAGES

[75] Inventor: Horst Loewenthal, Tiengen, Germany

[73] Assignee: SIG Schweizerische Industrie-Gesellschaft, Neuhausen am Rheinfall, Switzerland

[21] Appl. No.: 343,935

[22] Filed: Nov. 17, 1994

[30] Foreign Application Priority Data

Dec. 21, 1993 [CH] Switzerland ..... 3813/93

[51] Int. Cl.[6] ..... B65B 61/08; B65B 51/26

[52] U.S. Cl. ..... 53/374.4; 53/389.3; 83/337

[58] Field of Search ..... 53/374.4, 389.3; 83/304, 305, 337

[56] References Cited

U.S. PATENT DOCUMENTS

| | | | |
|---|---|---|---|
| 1,984,913 | 12/1934 | Biggert, Jr. | 83/305 X |
| 3,524,301 | 8/1970 | Zimmerman | 53/374.4 |
| 3,546,849 | 12/1970 | Zimmerman | 53/374.4 |
| 3,844,091 | 10/1974 | Vedvik et al. | 53/374.4 X |
| 3,982,381 | 9/1976 | Bolli | 53/374.4 |
| 4,164,833 | 8/1979 | Todd | 53/374.4 X |

FOREIGN PATENT DOCUMENTS 0384801 8/1990 European Pat. Off. .

574844 4/1976 Switzerland .

*Primary Examiner*—Horace M. Culver

*Attorney, Agent, or Firm*—Spencer, Frank & Schneider

[57] ABSTRACT

A cutting apparatus for separating a series of an indeterminate number of end-to-end connected bag packages into groups of a predetermined number of end-to-end connected bag packages includes a first rotary member including a knife; a second rotary member including a countersupport having an outer surface contacting the knife upon each revolution thereof, whereby a transverse seam connecting two adjoining bag packages and momentarily situated between the knife edge and the outer surface is cut. The outer surface is provided with a depression. The apparatus further has a shifting mechanism for shifting the rotary knife and the countersupport relative to one another into first and second positions. In the first position the knife passes across the depression for leaving a length portion of the knife out of contact with the outer surface, whereby the transverse seam remains uncut along the length portion to preserve a connecting web between the two adjoining bag packages. In the second position the knife is offset relative to the depression for allowing the knife to be throughout in contact with the outer surface, whereby the transverse seam is severed and the two adjoining bag packages are separated from one another.

5 Claims, 3 Drawing Sheets

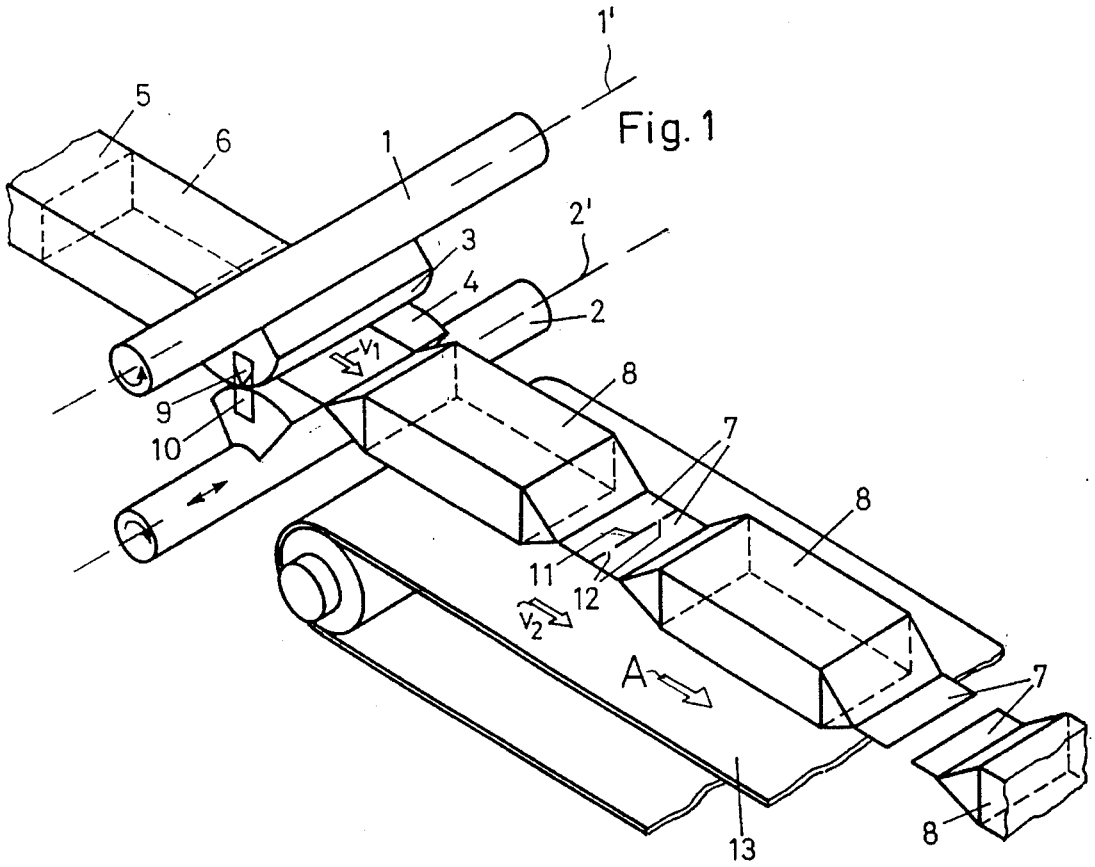
Fig. 1
Fig. 2
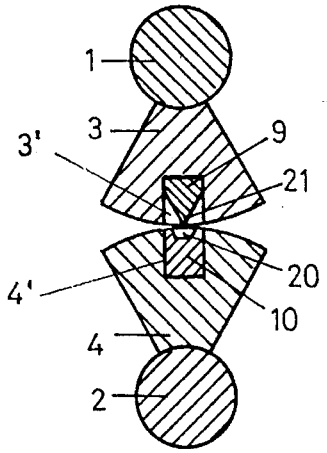

APPARATUS FOR MAKING GROUPS OF INTERCONNECTED BAG PACKAGES

CROSS REFERENCE TO RELATED APPLICATION

This application claims the priority of Swiss Application No. 3813/93-7 filed Dec. 21, 1993, which is incorporated herein by reference.

BACKGROUND OF THE INVENTION

This invention relates to an apparatus for making groups each formed of end-to-end interconnected bag packages.

Bags made of plastic wrapper sleeves are widely used for packaging food products, such as chocolate bars. Conventionally, groups of such packages are delivered in an interconnected state. This is achieved by not entirely severing the seam interconnecting the bags so that at least two connecting portions remain between adjoining bags. An apparatus for making such package groups is described, for example, in Swiss Patent No. 574,844. According to the prior art method, as the transverse sealing seam is provided, simultaneously a weakening line is pressed centrally into the seam. Thereafter, the packages are introduced onto a more rapidly travelling conveyor belt. One roll may selectively press the packages against the conveyor belt so that such package may be torn from the precedingly formed weakening line. Such a method, however, cannot be utilized in case the packaged products must not be exposed to pressure. Furthermore, the tearing stress exerted on the freshly formed transverse seam also involves problems.

SUMMARY OF THE INVENTION

It is an object of the invention to provide an improved apparatus of the above-outlined type which eliminates the above-discussed disadvantages.

This object and others to become apparent as the specification progresses, are accomplished by the invention, according to which, briefly stated, the cutting apparatus for separating a series of an indeterminate number of end-to-end connected bag packages into groups of a predetermined number of end-to-end connected bag packages includes a first rotary member including a knife; a second rotary member including a countersupport having an outer surface contacting the knife upon each revolution thereof, whereby a transverse seam connecting two adjoining bag packages and momentarily situated between the knife edge and the outer surface is cut. The outer surface is provided with a depression. The apparatus further has a shifting mechanism for shifting the rotary knife and the countersupport relative to one another into first and second positions. In the first position the knife passes across the depression for leaving a length portion of the knife out of contact with the outer surface, whereby the transverse seam remains uncut along the length portion to preserve a connecting web between the two adjoining bag packages. In the second position the knife is offset relative to the depression for allowing the knife to be throughout in contact with the outer surface, whereby the transverse seam is severed and the two adjoining bag packages are separated from one another.

BRIEF DESCRIPTION OF THE DRAWING

FIG. 1 is a perspective view of a preferred embodiment of the invention.

FIG. 2 is a side elevational sectional view of two cooperating components of the preferred embodiment.

DESCRIPTION OF THE PREFERRED EMBODIMENTS

Figure 3:
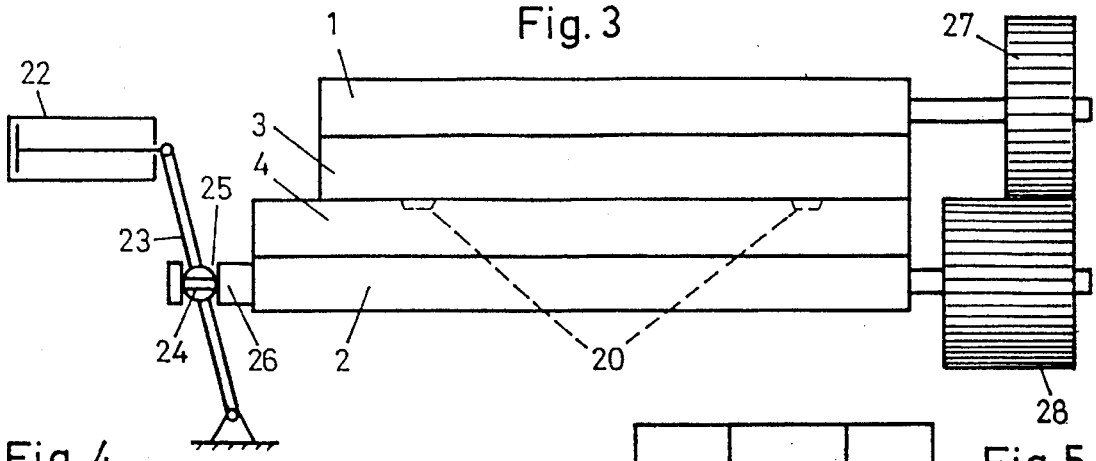
FIG. 3 is a front elevational view of some components of the preferred embodiment.

FIG. 1 illustrates a bag severing machine which includes two superposed, oppositely rotating rollers 1 and 2 to which respective cooperating sealing shoes 3 and 4 are secured. The rollers 1 and 2 have respective rotary axes 1' and 2'. A non-illustrated conveyor belt supplies a plastic wrapper sleeve (tube) 5 to the bight of the sealing shoes 3, 4. The sleeve 5 is made in a conventional manner on a sleeve bag forming machine and it contains products 6 (for example, chocolate bars) in regular distances from one another. By the application of pressure and/or heat, the sealing shoes 3 and 4 provide a wide transverse seam 7 in the sleeve between any two products 6, whereby a series of interconnected sleeve bag packages 8 are obtained. The sealing shoe 3 carries a knife 9 which is received in a groove 3' which is provided in the sealing shoe 3 and which extends parallel to the axis of rotation of the roller 1. The knife 9 cooperates with a countersupport 10 received in a groove 4' provided in the sealing shoe 4 and extending parallel to the rotary axis of the roller 2. The knife 9 cuts through the transverse seam 7 along its length, practically at the time it is being formed. The cut 11 provided by the knife 9 leaves two weak connecting portions (web portions) 12 between the two longitudinal halves of the transverse seam 7. It is understood that the number of uncut (web) portions 12 may be arbitrarily selected.

Downstream of the roller pair 1, 2, as viewed in the package advancing direction A, an endless conveyor belt 13 is positioned which moves the interconnected bags 8 away from the sealing and severing assembly. The speed $v_2$ of the belt 13 is greater than the circumferential speed $v_1$ of the sealing shoes 3 and 4 during the forming of the transverse seam 7. The rollers 1, 2 may, as known, rotate in a non-uniform manner.

Turning to FIGS. 2 and 3, the countersupport 10 has in its outer surface two spaced recesses (depressions) 20 which have a frustoconical cross-sectional shape and which, by virtue of an axial relative displacement between the rollers 1 and 2 may be placed into, or out of alignment with the cutting edge 21 of the knife 9. For this purpose the roller 2 is axially displaceable into two positions, for example, by a piston-and-cylinder unit 22 which engages into a groove 25 of the roller axle 26 by means of a lever 23 and a carrier member 24. The rollers 1 and 2 are coupled for rotation in opposite directions by means of meshing gears 27 and 28 coupled to non-illustrated drive motor.

Figure 4:
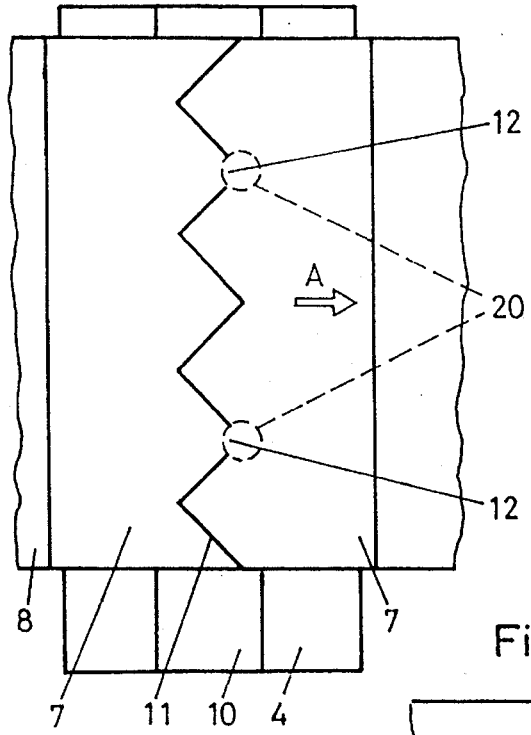
FIG. 4 is a top plan view of transverse seam regions of two interconnected bags situated on a component of the preferred embodiment.
Figure 5:
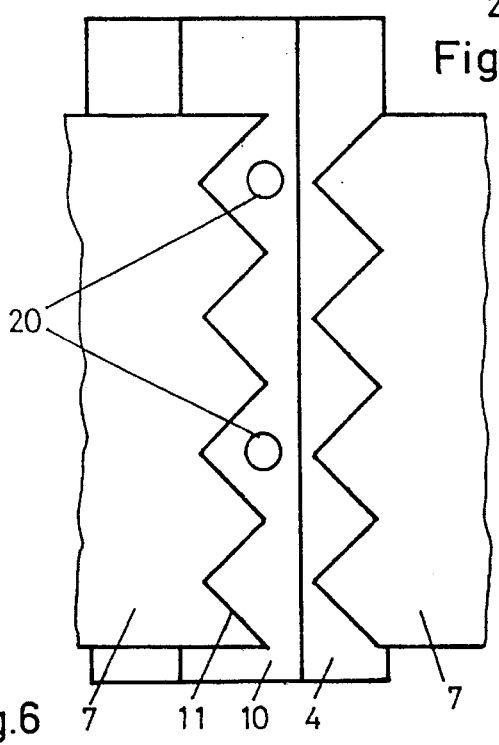
FIG. 5 is a top plan view of transverse seam regions of two separated bags situated on a component of the preferred embodiment.

The cutting edge 21 may be of zigzag configuration to result in a zigzag cut 11 shown in FIGS. 4 and 5 (for better visibility the cut 11 is shown in a significantly exaggerated manner). In one axial position of the roller 2 the recesses 20 of the countersupport 10 are in alignment with a length portion of the cutting edge of the knife 9, which means that along that length portion the cutting edge is not countersupported and therefore does not cut through the interposed bag seam, resulting in the interconnecting webs 12 (FIG. 4). If the roller 2 is shifted into its other axial position, the recess 20 will be out of alignment with the cutting edge of the knife 9, which means that the cutting edge is countersupported throughout its length by the surface of the countersupport 10 and thus the cut 11 is throughgoing and the preceding individual bag or groups of bags are fully severed (FIG. 5).

Figure 6:
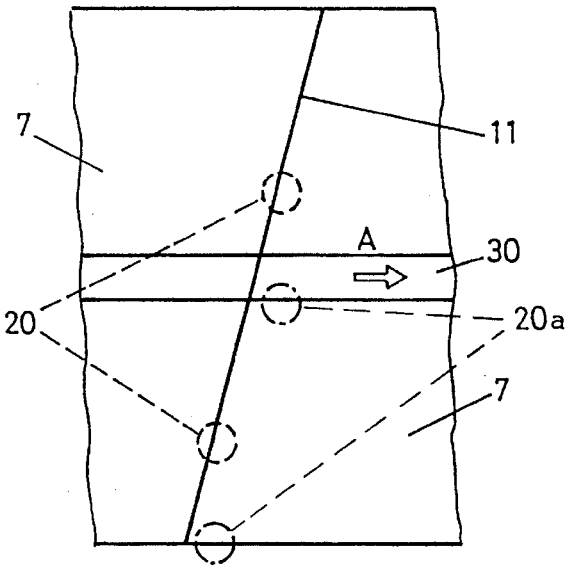
FIG. 6 is a top plan view of transverse seam regions of two interconnected bags situated on a component of another preferred embodiment.

FIG. 6 shows a variant where the cutting edge of the knife and thus the cut 11 are linear and are oriented at an acute angle to the bag advancing direction A. In this embodiment too, the recesses are either in alignment with the cutting edge as shown at 20, in which case the cut is interrupted, or they are—after an axial displacement of the rolls 1 and 2 relative to one another—out of alignment with the cutting edge as shown at 20*a* in which case the cut is uninterrupted. FIG. 6 also shows a longitudinal bag seam 30 oriented parallel to the advancing direction A.

Figure 7:
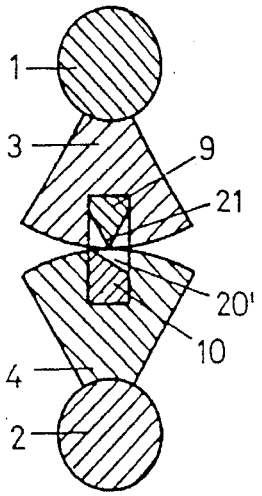
FIG. 7 is a sectional side elevational view of two cooperating components of another preferred embodiment of the invention.
Figure 8:
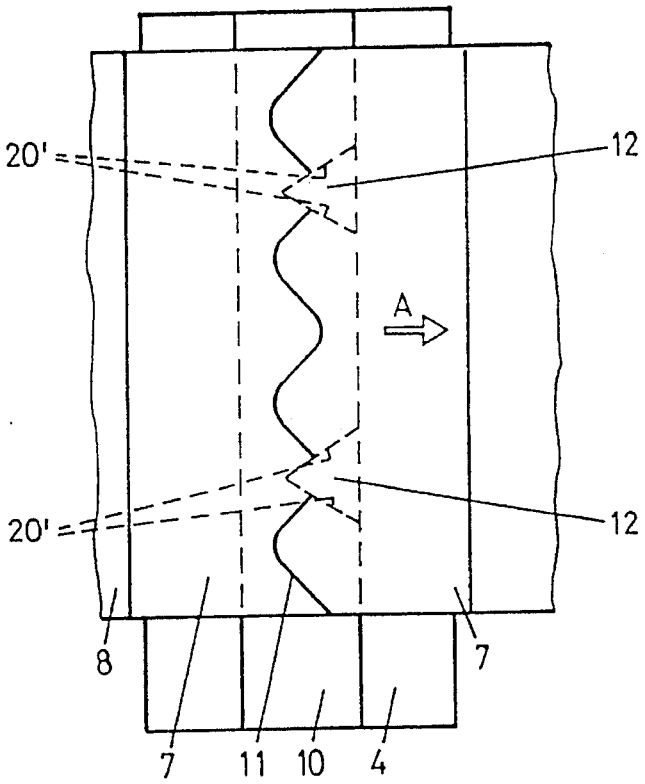
FIG. 8 is a top plan view of transverse seam regions of two interconnected bags situated on a component of another preferred embodiment.

FIGS. 7 and 8 illustrate further variants of the invention where the recesses 20' provided laterally in the countersupport 10 are of triangular shape.

It is apparent that the number of recesses provided in the countersupport 10 determines the number of the interconnecting webs 12.

In each variant based on an axial relative motion between rollers 1 and 2 the webs 12 are always in a zone of the cut 11 which is oriented at an acute angle with the advancing direction A.

Thus, by means of the apparatus according to the invention, individual (separate) bags or groups of a desired number of interconnected bags may be selectively formed in a very simple manner. For this purpose, the roller 2 is, by the power cylinder unit 22, moved after a settable number of revolutions from the position shown in FIG. 4 into the position shown in FIG. 5 (to thus shift the axial position of the recesses) and after one revolution the roller 2 is moved back into its position shown in FIG. 4. In this procedure the products 6 themselves are not contacted so that pressure sensitive products may be processed in a safe manner with the apparatus according to the invention. The setting to another number of the bags forming one group may be effected in a simple manner.

Figure 9:
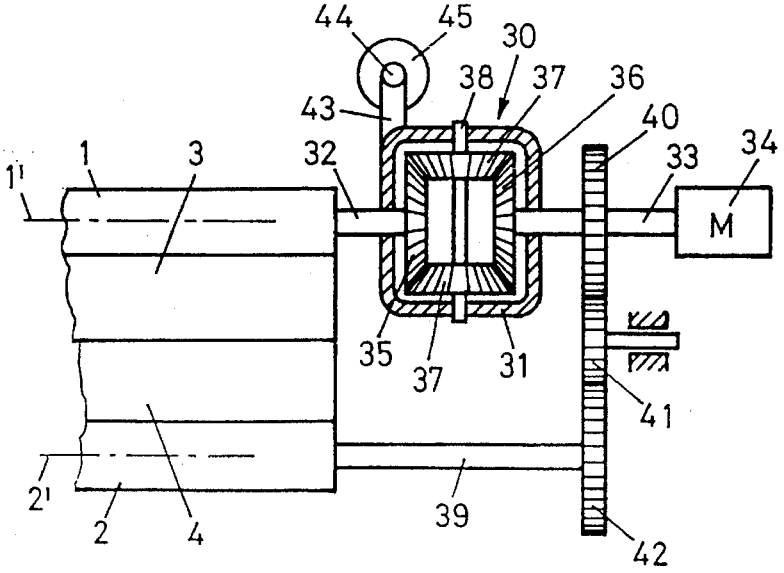
FIG. 9 is a partial side elevational section of another embodiment.

Departing from the above-described embodiment it is further feasible to bring the recesses 20 into or out of alignment with the cutting edge of the knife 9 by a rotation of the rollers 1 and 2 relative to one another. For this purpose, for example, the gears 27 and 28 may be replaced by a differential gearing 30 shown in FIG. 9. The gearing 30 comprises a cage 31 which supports two coaxial axles 32, 33. The axle 32 is connected to roller 1 and the axle 33 to a driving motor 34. On their free end within the cage 31 the axles 32, 33 carry bevel gears 35, 36 which each mesh with two bevel pinions 37 freely rotatably supported on a traverse axle 38 fixed in the cage 31. The axle 33 is connected to a further axle 39 coupled to the roller 2 via three spur gears 40, 41, 42. The cage 31 carries an arm 43' which, at its free end, is coupled to a piston rod 44 of a cylinder unit 45. By means of the cylinder unit 45 the cage 31 can be rotated about the axles 32, 33 into two rotary positions.

When the axle 33 is driven by the motor 34 the rollers 1, 2 counterrotate at equal rate. By pivoting the cage 31 by means of the cylinder unit 45 from one position to the other position the roller 1 is retarded or advanced relative to the roller 2 by an angle determined by the pivot angle of the cage, so that the knife edge 21 comes into or out of alignment with the recesses. In this case the cutting edge (and thus the cut 11) may extend linearly and parallel to the rotary axis (that is, perpendicularly to the advancing direction A).

It may be expedient to form the recesses 20 such that they have a pyramid or prism shape or to provide them as lateral recesses 20' in a desired shape on the countersupport 10.

It will be understood that the above description of the present invention is susceptible to various modifications, changes and adaptations, and the same are intended to be comprehended within the meaning and range of equivalents of the appended claims.

What is claimed is:

1. A cutting apparatus for separating a series of an indeterminate number of end-to-end connected bag packages into groups of a predetermined number of end-to-end connected bag packages, comprising (a) a first rotary member having a rotary axis and including a knife having a knife edge orbiting about said rotary axis upon rotation of said first rotary member;

(b) a second rotary member having a rotary axis spaced from the rotary axis of said first rotary member; said second rotary member including a countersupport having (1) an outer surface contacting said knife edge upon each revolution thereof, whereby a transverse seam connecting two adjoining bag packages and momentarily situated between the knife edge and the outer surface is cut; and (2) a depression provided in said outer surface; and (c) shifting means for shifting said rotary knife and said countersupport relative to one another into first and second positions; in said first position said knife edge, when in contact with said outer surface, passes across said depression for leaving a length portion of said knife edge out of contact with said outer surface, whereby the transverse seam remains uncut along said length portion to preserve a connecting web between said two adjoining bag packages; in said second position said knife edge, when in contact with said outer surface, is offset relative to said depression for allowing said knife edge to be throughout in contact with said outer surface, whereby the transverse seam is severed and said two adjoining bag packages are separated from one another.

2. The cutting apparatus as defined in claim 1, wherein said shifting means comprises means for shifting said rotary countersupport parallel to the rotary axis thereof relative to said rotary knife.

3. The cutting apparatus as defined in claim 1, wherein said shifting means comprises means for circumferentially shifting said rotary countersupport relative to said rotary knife.

4. The cutting apparatus as defined in claim 1, wherein said first and second rotary members include cooperating sealing shoes carrying said knife and said countersupport, respectively; said cooperating sealing shoes providing said transverse seam.

5. The cutting apparatus as defined in claim 1, wherein said bag packages pass between said first and second rotary members in a direction of advance; said knife edge having a length portion oriented at an acute angle to said direction of advance.

* * * * *